United States Patent [19]

Sarver et al.

[11] 4,343,567

[45] Aug. 10, 1982

[54] SELF-ERECTING ROADWAY MARKING POST

[75] Inventors: Robert B. Sarver, Carson City, Nev.; W. Eugene Arthur, Foster City, Calif.

[73] Assignees: Robert D. Cunningham; Byron F. West, both of Hayward, Calif. ; a part interest to each

[21] Appl. No.: 125,244

[22] Filed: Feb. 27, 1980

[51] Int. Cl.[3] ..... E01F 9/00

[52] U.S. Cl. ..... 404/10; 256/1; 403/109

[58] Field of Search ..... 404/10, 9; 248/156, 248/548, 549; 256/1, 13.1; 52/153, 160, 165; 40/606, 612; 81/463; 350/107; 173/91; 403/109, 280, 281, 349, 374

[56] References Cited

U.S. PATENT DOCUMENTS

| | | | |
|---|---|---|---|
| 1,726,817 | 9/1929 | Franklin | 404/10 X |
| 1,916,787 | 7/1933 | Elston | 404/9 |
| 3,066,769 | 12/1962 | Pasquale | 248/156 X |
| 3,279,133 | 10/1966 | DeKorte | 404/10 X |
| 3,371,647 | 3/1968 | Shopbell | 404/10 X |
| 3,381,763 | 5/1968 | Matson | 173/91 |
| 3,519,234 | 7/1970 | Matson | 173/91 X |
| 4,078,867 | 3/1978 | Ronden | 404/10 |
| 4,084,914 | 4/1978 | Humphrey et al. | 404/10 |
| 4,092,081 | 5/1978 | Schmanski | 404/10 |
| 4,106,879 | 8/1978 | Diedershagen et al. | 404/10 |
| 4,123,183 | 10/1978 | Ryan | 404/10 |
| 4,240,766 | 12/1980 | Smith et al. | 256/1 X |

FOREIGN PATENT DOCUMENTS

| | | | |
|---|---|---|---|
| 823492 | 12/1951 | Fed. Rep. of Germany | 403/374 |
| 1814255 | 6/1970 | Fed. Rep. of Germany | 404/10 |
| 579680 | 9/1976 | Switzerland | 404/10 |
| 282559 | 7/1972 | United Kingdom | 404/10 |
| WO79/00809 | 10/1979 | PCT Int'l Appl. | 404/10 |

OTHER PUBLICATIONS

"No. 306 Pin Extractor", *Fracture Equipment Catalog;-/*Zimmer Mfg. Co., Warsaw, Ind., Feb. 1, 1947, p. 26.

*Primary Examiner*—Rodney H. Bonck
*Attorney, Agent, or Firm*—Jacox & Meckstroth

[57] ABSTRACT

A metal anchor tube is driven into the ground or blacktop and defines a cavity which receives the lower end portion of an elongated cylindrical flexible marking tube extruded from a resilient plastics material. The upper end portion of the marking tube supports a light reflecting member which may be in the form of a reflective sheet located within the marking tube and visible through an opening or window within the tube. In one embodiment, the lower end portion of the marking tube is releasably coupled to the anchor tube by an internal wedge plug which compresses the marking tube against the anchor tube and is inserted and removed by means of a tool. In another embodiment, the releasable coupling is formed by an anchor tube having tabs which project inwardly into corresponding holes within the flexible marking tube. A flexible plastic reinforcing tube extends within the marking tube and assures the self-erecting of the marking tube to an upright vertical position after the marking tube has been impacted and bent by a motor vehicle accidentally passing over the tube.

12 Claims, 11 Drawing Figures

SELF-ERECTING ROADWAY MARKING POST

BACKGROUND OF THE INVENTION

There have been a number of roadway or highway guide or marking posts which are constructed either of a flexible material or are spring biased in order to be self-erecting in the event the marking post is accidentially hit and bent by a motor vehicle which leaves the roadway. For example, U.S. Pat. Nos. 4,084,914; 4,092,081; 4,106,879 and 4,123,183 disclose various forms of self-erecting roadway marking posts.

In the design of such a marking post, it is highly desirable for the post to be constructed in a manner which provides for quick and simple installation. The post should also be able to withstand many dozens of impacts from the bumpers of high speed vehicles without damaging or destroying the post and without pulling the post out of the ground. The ease and speed of installation is particularly important in view of the large number of marking posts which are used along the highways and expressways and the fact that frequently the installation of marking posts is performed when the installer is exposed to substantial motor vehicle traffic.

For the same reasons, it is also highly desirable for a marking post to be designed for quick and conventional replacement in the event that the post is destroyed or is no longer usable. In addition, it is desirable for the post to be installed in a manner by which the post may not be easily damaged or removed by a person walking along the roadway. The marking post should also carry a reflecting material which cannot be easily scraped from the post by the underneath surface of a motor vehicle hitting and passing over the post.

SUMMARY OF THE INVENTION

The present invention is directed to an improved self-erecting roadway marking device or post which provides all of the desirable features and advantages mentioned above and which is also adapted for economical construction. In accordance with one emodiment of the invention, these advantages are provided by a marking post which includes a rigid metal anchor tube having a swaged lower end portion adapted to be driven into the ground or into a blacktop border or shoulder portion of a roadway. The anchor tube receives the lower end portion of a marking tube extruded of a resilient plastics material and which is self-erecting after it is bent through an angle of over 90°.

The lower end portion of the marking tube is secured to the anchor tube by a releasable coupling. In one embodiment, the coupling includes a wedge plug which compresses the lower end portion of the marking tube outwardly against the anchor tube and is adapted to be inserted and removed with the aid of an elongated tool inserted into the marking tube. In another embodiment, the releasable coupling includes a set of tabs which are lanced from the anchor tube and project inwardly and downwardly through corresponding holes within the lower end portion of the flexible marking tube.

The upper end portion of the marking tube carries a light reflector which in one embodiment includes a reflective sheet inserted into the tube at a location where it is visible through a window formed within the tube. A resilient plastic reinforcing tube is inserted within a long marking tube so that it bends with the marking tube and aids in returning the marking tube to its normal upright position after it is hit.

Other features and advantages of the invention will be apparent from the following description, the accompanying drawings and the appended claims.

DESCRIPTION OF THE PREFERRED EMBODIMENTS

Figure 1:
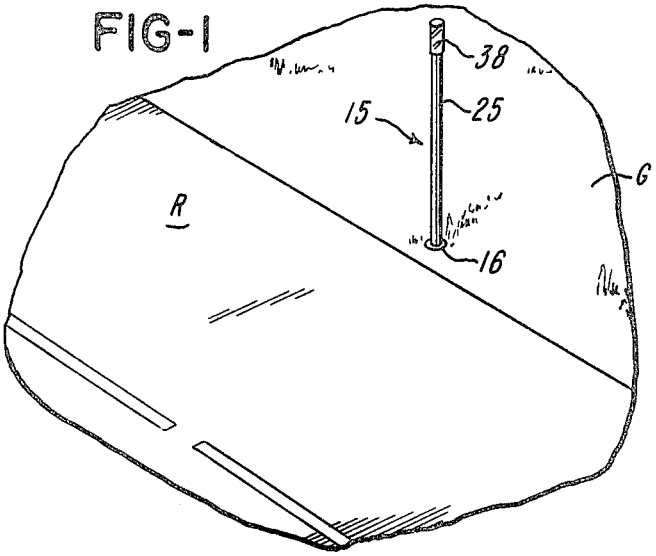
FIG. 1 is a perspective view of a self-erecting roadway marking post constructed in accordance with the invention and illustrating its installation adjacent a roadway.

FIG. 1 illustrates a self-erecting roadway marking post 15 which is inserted or installed within the ground G adjacent a roadway R. The marking post 15 includes a cylindrical anchor tube 16 (FIG. 2) which is constructed of welded cold-rolled steel tubing and includes an outwardly projecting upper flange portion 18. The anchor tube 16 has a compacted or swaged-together lower end portion 19 which forms a relatively sharp bottom edge 21. Preferably, the anchor tube 16 is constructed of 14-gauge steel tubing similar to an engine exhaust pipe and may be provided with an aluminized protective coating.

Figure 3:
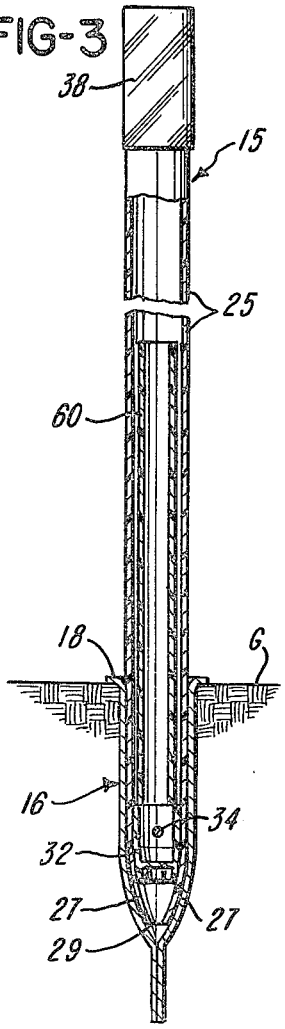
FIG. 3 is a vertical section an part elevational view of the marking post shown in FIGS. 1 and 2 and illustrating its installation within the ground.
Figure 9:
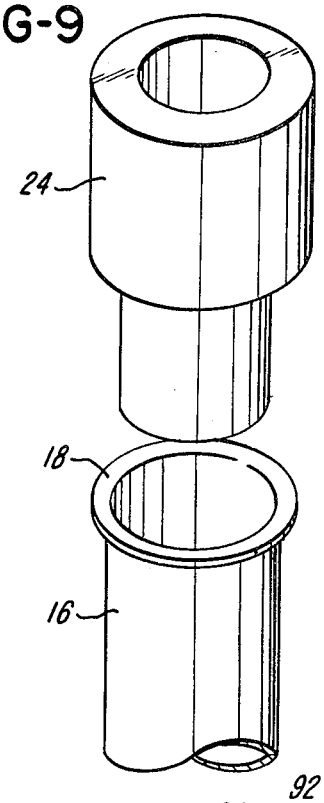
FIG. 9 is a perspective view of an adapter used for driving the anchor tube into the ground.

The rigid anchor tube 16 is adapted to be driven into the ground G, as illustrated in FIG. 3, by means of an adapter 24 (FIG. 9) having a radial shoulder for engaging the flange 18. The adapter 24 may be attached to a portable gasoline engine driven impact drill or may be driven manually with a large hammer. The flat lower edge portion 19 of the anchor tube 16 enables the anchor tube to be driven by means of the adapter 24 through an asphalt shoulder portion of a roadway in the event such installation is required.

An elongated cylindrical marking member or tube 25 is extruded from a plastics material which can withstand a wide range of temperatures, such as a high density polyethylene or a polyester elastomer material, for example, as sold by Dupont de Nemours under the trademark HYTREL. The marking tube 25 is capable of being flexed or bent many times through an angle of over 90° and will return after each bend to a straight normal condition without causing any damage to the tube. The length of the marking tube 25 depends on the form of roadway marking desired and may extend, for example, from 18 inches to 48 inches.

The outside diameter of the marking tube 25 is slightly less than the inside diameter of the anchor tube 16, and the lower end portion of the marking tube receives a series of pressure-sensitive strips 27 having a high friction abrasive outer surface. As shown in FIG. 3 after the anchor tube 16 is driven into the ground, the lower end portion of the marking tube 25 is inserted into the anchor tube 16 until the lower tip portion 29 of the marking tube is deformed or cammed inwardly by the tapering lower end portion 19 of the anchor tube 16. In this position, the friction strips 27 press firmly against the inner surface of the anchor tube. A wedge or lock plug 32 (FIGS. 2 and 3) is then inserted into the marking tube 25 and is preferably molded of a relatively rigid plastics material such as polyvinyl chloride. Circumferentially spaced slits 33 are formed within the lower end portion of the lock plug 32, and a metal cross pin 34 (FIG. 3) is inserted into aligned holes within the upper end portion of the plug.

A flexible sheet 38 of light reflecting material is wrapped around the upper end portion of the marking tube 25 and is secured to the tube by pressure-sensitive adhesive on the back of the sheet. One form of the reflective sheet which has proven satisfactory during experimental testing, is a polycarbonate reflective sheeting manufactured by Reflexite Corporation in Bridgeport, Conn.

Figure 7:
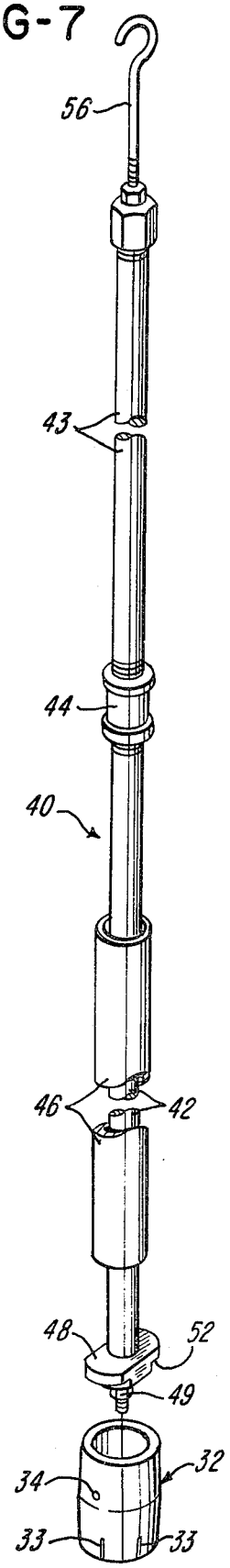
FIG. 7 is a perspective view of a tool device which is used for inserting and removing a tube lockin plug used in the embodiment shown in FIG. 3.

After the lower end portion of the marking tube 25 is inserted into the anchor tube 16, the lock plug 32 is inserted into the marking tube 25 and is driven downwardly into the tube by an insertable tool 40 (FIG. 7) until the plug 32 firmly compresses the lower end portion of the tube 25 and friction strips 27 into positive engagement with the inner surface of the anchor tube 16. As shown in FIG. 7, the elongated tool 40 is approximately six feet in length and includes a first end pipe section 42 and a second end pipe section 43 threadably connected by a coupling 44 so that the sections may be disassembled. The end section 42 carries a tubular hammer or impact member 46 which is adapted to be shifted axially on the end section 42. A steel pad 48 is secured by a bolt 49 to the outer end of the section 42 and has an outer diameter slightly less than the inside diameter of the marking tube 25. The pad 48 has opposite shoulders 52 which are adapted to engage the upper end of the lock plug 32 when it is desired to use the tool 40 to press or force the plug 32 downwardly within the marking tube 25 to lock the marking tube to the anchor tube 16, as shown in FIG. 3.

Figure 8:
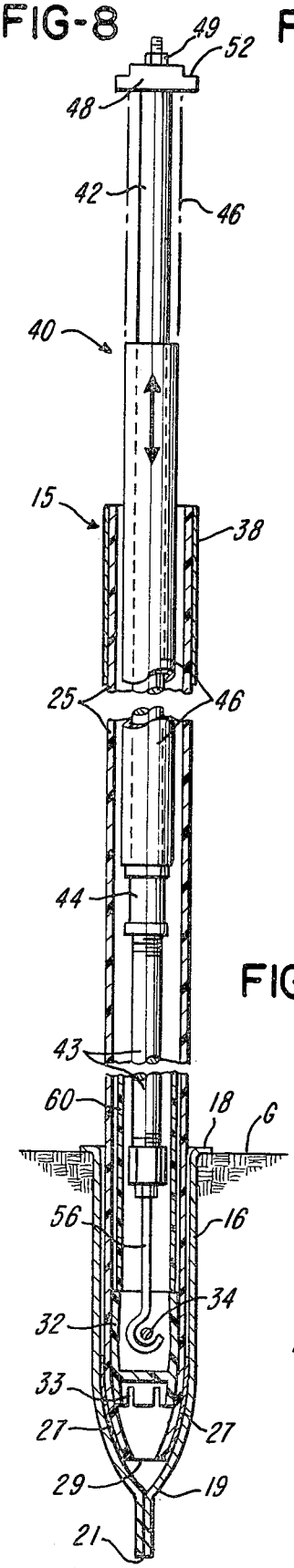
FIG. 8 is an elevational view of the tool device and illustrating how the tool device is used for removing the locking plug shown installed in FIG. 3.

A hook element 56 is attached to the outer end of the pipe section 43 and adapts the tool 40 for removing the lock or wedge plug 32 in the event it becomes necessary to replace a damaged marking tube 25 with a new marking tube. As shown in FIG. 8, to remove the lock plug 32, the tool 40 is inverted and inserted into the marking tube 25 until the hook element 56 is adjacent the cross pin 34 within the lock plug. The tool 40 is then rotated 90° so that the hook element 56 receives the cross pin. The impact tube 46 is then tapped against the pad 48 to release and pull the lock plug 32 so that the marking tube 25 may be pulled from the anchor tube 16.

Figure 2:
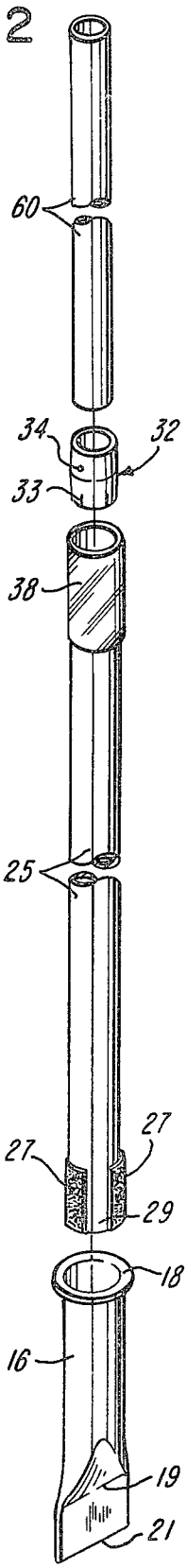
FIG. 2 is an exploded perspective view of the components which form the marking post shown in FIG. 1.

As shown in FIGS. 2 and 3, a flexible tube erecting member or reinforcing tube 60 is formed from an extrusion of plastics material such as low density polyethylene, and has an outside diameter smaller than the inside diameter of the marking tube 25. After the lock plug 32 is installed in its locked position (FIG. 3), the reinforcing tube 60 is inserted into the marking tube 25 until the tube 60 seats on top of the lock plug 32. In this position, a portion of the tube 60 projects below the ground surface and into the anchor tube 16 and a portion of the tube 60 projects above the ground surface into the marking tube 25. The reinforcing tube 60 is particularly useful when the marking tube 25 projects several feet above the ground since the tube 60 functions to assure that the marking tube 25 is self-erecting after it has been impacted and bent to an angle of approximately 90°. That is, the insert tube 60 bends with the marking tube 25 and reinforces its flexibility to assure that the marking tube flips back to a vertical upright position after the marking tube is released from a motor vehicle passing over the tube. The reinforcing tube 60 is also of sufficient diameter to permit the tool 40 to extend through the tube 60, as illustrated in FIG. 8, when it is desired to disconnect or uncouple the marking tube 25 from the anchor tube 60.

Figure 4:
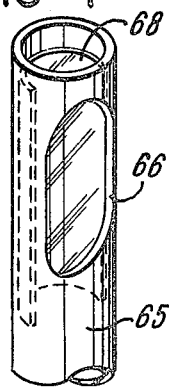
FIG. 4 is a fragmentary perspective view of the upper end portion of a modified marking post constructed in accordance with the invention.

Referring to FIG. 4, a modified marking tube 65 is extruded in the same manner as the marking tube 25, and an oval window or opening 66 is formed within the upper end portion of the tube 56. A sheet 68 of light reflective material is inserted into the marking tube 65 and is attached by pressure sensitive adhesive to the inner surface of the tube so that the reflective surface of the sheet 68 is visible through the opening 66. The primary advantage of the modification shown in FIG. 4 is the protection of the reflective sheet 68 so that the sheet will not be damaged or scraped from the marking tube 65 by the underneath surface of a motor vehicle which impacts the tube 65 and passes over the tube.

Figure 5:
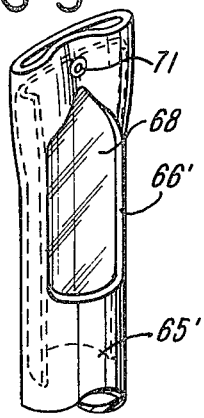
FIG. 5 is a view similar to FIG. 4 and showing another modification of a marking post constructed in accordance with the invention.

In the modification shown in FIG. 5, a marking tube 65' has a chevron shaped opening 66', and the upper end portion of the flexible tube is pinched together and secured by a rivet 71. This modification substantially reduces the chance of a projection on the underneath side of a motor vehicle entering the opening 66' and damaging or tearing the end portion of the tube 65'.

Figure 6:
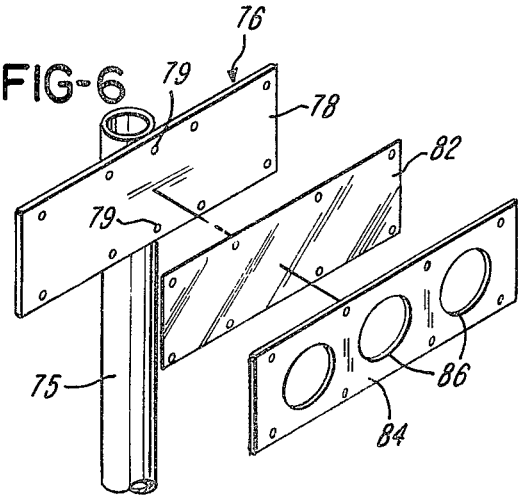
FIG. 6 is an exploded perspective view of a further modification of a marking post constructed in accordance with the invention.

Referring to FIG. 6, a marking tube 75 is extruded in the same manner as the marking tubes 25, but in place of attaching a reflective sheet 38, the tube 75 supports a laterally extending or T-shaped reflector head 76. The reflector head 76 includes a flat plastic base panel 78 which is secured by rivets 79 to the upper end portion of the marking tube 75. A sheet 82 of reflective material is attached to the panel 78 by pressure-sensitive adhesive and is overlaid by a front plastic panel 84 having a series of three circular apertures 86. The panels 78 and 84 are secured together by peripherally spaced rivets or cement, and the reflective sheet 82 is visible through the apertures 86.

Figure 10:
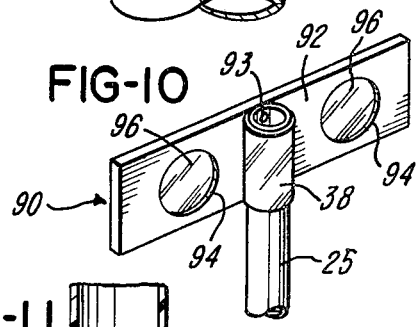
FIG. 10 is a perspective view of the upper end portion of a modified marking post constructed in accordance with the invention.

As shown in FIG. 10, another form of laterally extending reflector head 90 is constructed by attaching a panel 92 of rigid plastics material to the upper end portion of the marking tube 25 by a set of rivets 93. The panel 92 is provided with a set of circular recesses 94 each of which receives a circular sheet 96 of light reflective material. Thus the reflector head 90 is attached to the back side of the marking tube 25 so that the sheets 96 of reflecting material are visible along with the sheet 38 which extends around the upper end portion of the tube 25.

Figure 11:
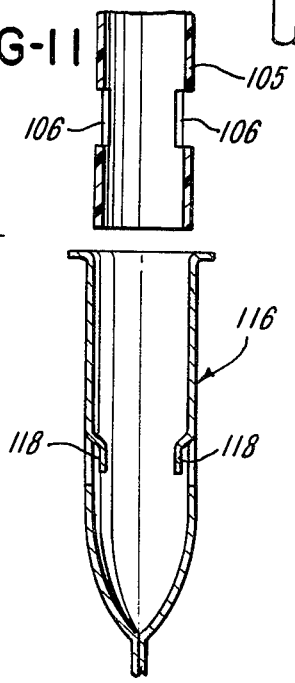
FIG. 11 is a fragmentary section of a marking tube and an anchor tube constructed in accordance with another modification of the invention.

In place of the friction type releasable coupling of the marking tube 25 to the anchor tube 16, as discussed above in connection with FIGS. 2, 3, 7 and 8, another form of releasable coupling is illustrated in FIG. 11. In this modification, a marking tube 105 is extruded in the same manner as the marking tube 25. However, the lower end portion of the marking tube 105 includes diametrically opposed rectangular holes or openings 106. An anchor tube 116 is constructed the same as the anchor tube 16, but is provided with a pair of diametrically opposed tabs 118 which are lanced inwardly from the tube and project inwardly and downwardly to form flat hooks.

When the resilient marking tube 105 is inserted into the anchor tube 116, the flexibility of the marking tube 105 allows the lower end portion of the marking tube to be deformed or cammed inwardly by the tabs 118. When the tube 105 bottoms within the anchor tube 116, the bottom portions of the marking tube 105 under the openings 106, snap outwardly under the tabs 118 which project into the openings 106. The marking tube 105 is then pulled upwardly so that the bottom tube portions are hooked under the tabs 118 to form a positive and rigid connection or coupling of the marking tube 105 to the anchor tube 116.

To remove the marking tube 105, the tube is pushed downwardly and rotated 90°, after which the tube 105 may be pulled from the anchor tube 116. When the reinforcing tube 60 is inserted into the marking tube 105, the tube 60 restricts rotation and axial movement of the tube 105 and thereby restricts releasing of the tube 105 from the tabs 118 until the reinforcing tube 60 is removed or pulled upwardly within the tube 105. This upward movement of the tube 60 is performed by a tool or rod having a hooked end portion for engaging a cross-pin (not shown) in the reinforcing tube 60, similar to the removal of the lock plug 32.

From the drawings and the above description, it is apparent that a self-erecting roadway marking post constructed in accordance with the present invention, provides desirable features and advantages. For example, the marking post may be quickly and easily installed simply by driving the anchor tube 16 or 116 into the ground and inserting the corresponding marking tube 25 or 105. In addition, the marking tube is quickly locked to the anchor tube in a positive manner by means of either the lock plug 32 or the hook-shaped connecting tabs 118. The locking systems also prevent loss of the marking tubes by vandalism since the marking tubes cannot be simply pulled from the anchor tubes. The marking post is also adapted to receive dozens of impacts by motor vehicles without significant damage so that the marking tube has a service life for many years.

As another feature, the reinforcing tube 60 provides for minimizing the material and wall thickness of the marking tube while providing for self-erecting of a marking tube having substantial length or height. A marking post of the invention also provides for easily and quickly replacing a marking tube in the event the tube is damaged so that it is no longer usable. As a result, the time and labor required for installing and replacing marking posts by state highway departments, are substantially reduced, thereby enabling more effective use of state highway funds and reducing the exposure of the highway personnel to traffic. As also described above, a marking post constructed in accordance with the invention significantly reduces the chance of a marking tube being pulled from the ground when the post is accidentally impacted by a motor vehicle.

While the forms of self-erecting marking posts herein described constitute preferred embodiments of the invention, it is to be understood tht the invention is not limited to these precise forms of posts, and that changes may be made therein without departing from the scope and spirit of the invention as defined in the appended claims.

The invention having thus been described, the following is claimed:

1. A self-erecting roadway marking post comprising an elongated flexible and resilient marking tube of plastics material and having an annular cross-sectional configuration, said marking tube having a lower end portion adapted to project downwardly into a hole defined within the ground and an upper portion projecting substantially above the ground, means no said upper portion of said marking tube for reflecting light, said upper portion of said marking tube being capable of bending above the ground through an angle of ninety degrees in response to being accidentally impacted by a motor vehicle, an elongated tube erecting member of resilient flexible material, said erecting member extending with said upper and lower portions of said marking tube and being completely surrounded by said marking tube, said erecting member having an intermediate portion disposed for bending within said marking tube when impacted by the motor vehicle, and said erecting member and the surrounding said marking tube being cooperatively effective to provide said marking post with a substantial number of self-erections in response to vehicle impacts on said marking post while minimizing the damage of said marking post.

2. A marking post as defined in claim 1 wherein said erecting member comprises an extruded tube of plastics material.

3. A marking post as defined in claim 1 wherein said marking tube is generally cylindrical, and said erecting member comprises a generally cylindrical tube of extruded resilient plastics material.

4. A marking post as defined in claim 1 and including means for retaining said marking tube within the ground, and said lower portion of said marking tube partially collapses in response to engagement of said retaining means.

5. A marking post as defined in claim 1 wherein said erecting member restrains against partial collapsing of said lower end portion of said marking tube after said erecting member is positioned within said marking tube.

6. A marking post as defined in claim 1 and including a rigid anchor tube adapted to be inserted into the ground, said anchor tube having at least one inwardly and downwardly projecting hook member, said lower end portion of said marking tube projecting into said anchor tube and having means defining at least one opening for receiving said hook member, and said lower end portion of said marking tube is partially collapsed inwardly in response to engagement by said hook member when said marking tube is inserted axially into said anchor tube.

7. A marking post as defined in claim 10 and including an elongated tube erecting member of resilient plastics material and extending within said upper and lower portions of said marking tube for bending with said marking tube.

8. A marking post as defined in claim 7 wherein said erecting member comprises a generally cylindrical resilient tube.

9. A marking post as defined in claim 1 and including means securing said upper portion of said marking tube in a compressed-together condition.

10. A self-erecting roadway marking post comprising an elongated flexible and resilient marking tube of plastics material and having an annular cross-sectional configuration, said marking tube having a lower end portion and an upper portion, a rigid anchor tube adapted to be inserted into the ground for receiving said lower end portion of said marking tube, said upper portion of said marking tube projecting substantially above the ground, means on said upper portion of said marking tube for reflecting light, said upper portion of said marking tube being capable of bending above the ground through an angle of ninety degrees in response to being accidentally impacted by a motor vehicle and of returning to an upright position, said anchor tube having at least one rigid hook member projecting inwardly and downwardly into said anchor tube with its lower end disposed within said anchor tube, said lower end portion of said marking tube projecting into said anchor tube and having means defining at least one opening for receiving said hook member, said lower end portion of said resilient marking tube being effective to collapse inwardly in response to engagement by said rigid hook member when said marking tube is inserted downwardly into said anchor tube, said lower end portion of said marking tube being effective to snap outwardly from its collapsed condition when said hook member aligns with said opening, and said hook member being effective to hook said lower end portion of said marking tube when said marking tube is pulled upwardly after said hook member projects into said opening to form a positive coupling of said marking tube with said anchor tube.

11. A self-erecting roadway marking post comprising an elongated flexible and resilient marking tube of plastics material and having an annular cross-sectional configuration, said marking tube having a lower end portion adapted to project downwardly into a hole defined within the ground and an upper portion projecting substantially above the ground, means on said upper portion of said marking tube for reflecting light, said upper portion of said marking tube being capable of bending above the ground through an angle of ninety degrees in response to being accidentally impacted by a motor vehicle, an elongated tube erecting member of resilient flexible material, said erecting member extending with said upper and lower portions of said marking tube and being completely surrounded by said marking tube, said erecting member having an intermediate portion disposed for bending within said marking tube when impacted by the motor vehicle, said erecting member and the surrounding said marking tube being cooperatively effective to provide said marking post with a substantial number of self-erections in response to vehicle impacts on said marking post while minimizing the damage to said marking post, a rigid anchor tube for defining said hole within the ground and having at least one rigid hook member projecting inwardly and downwardly into said hole, and said lower end portion of said marking tube projecting into said anchor tube and having means defining an opening receiving said hook member with said hook member engaging said lower end portion of said marking tube.

12. A self-erecting roadway marking post comprising an elongated flexible and collapsible marking tube of resilient plastics material and having an annular cross-sectional configuration, said marking tube having a lower end portion adapted to project downwardly into a hole defined within the ground and an upper portion projecting substantially above the ground, means on said upper portion of said marking tube for reflecting light, fastener means securing the upper end portion of said marking tube in a compressed-together condition, said upper portion of said marking tube being capable of bending above the ground through an angle of ninety degrees in response to being accidentally impacted by a motor vehicle and of returning to an upright position, an elongated tube erecting member of resilient flexible material and extending within said upper and lower portions of said marking tube for bending with said marking tube, and said erecting member cooperating with the surrounding said marking tube to provide said marking post with a substantial number of self-erections in response to vehicle impacts on said marking post while minimizing the damage to said marking post.

* * * * *